United States Patent [19]

Freerks

[11] Patent Number: 4,523,411

[45] Date of Patent: Jun. 18, 1985

[54] WET SURFACE TREATING DEVICE AND ELEMENT THEREFOR

[75] Inventor: Conrad T. Freerks, Maplewood, Minn.

[73] Assignee: Minnesota Mining and Manufacturing Company, Saint Paul, Minn.

[21] Appl. No.: 451,281

[22] Filed: Dec. 20, 1982

[51] Int. Cl.[3] ..... B24B 23/02; B24B 55/02

[52] U.S. Cl. ..... 51/170 MT; 51/209 R; 51/267

[58] Field of Search ..... 51/267, 170 R, 170 T, 51/170 MT, 363, 358, 209 R

[56] References Cited

U.S. PATENT DOCUMENTS 2,840,960 7/1958 Booth ..... 51/267

3,153,885 10/1964 Keller et al. ..... 51/209 R

FOREIGN PATENT DOCUMENTS 1215064 12/1970 United Kingdom ..... 51/267

*Primary Examiner*—Roscoe V. Parker

*Attorney, Agent, or Firm*—Donald M. Sell; James A. Smith; Richard Francis

[57] ABSTRACT

A rotatable element and a surface treating device including the same are provided. The rotatable element is capable of being mounted on the end of the output shaft of a conventional surface treating device, such as an orbiting disc sander, an orbital sander, a polisher (e.g., hand-held or floor polisher), floor buffer or scrubber etc., to provide a device modified according to the invention. The element comprises a first surface including a shaft mounting means for rotation of the element about an axis generally transverse to the first surface and an opposite second surface comprising or being capable of including a surface treating means. The first surface also includes a basin-like recess having a bottom surface which is generally transverse to the axis and substantially free of radial undulations and the first surface also includes sidewalls defining a channel opening toward and extending around the axis. The opposite second surface also includes an opening within or adjacent an area generally centered with respect to the axis. The element includes at least one passage therethrough communicating between the channel and the opening in the second surface so that liquid collected in the recess will flow to the channel, through the passage and out of the opening when the element is stationary or rotated about the axis.

1 Claim, 5 Drawing Figures

WET SURFACE TREATING DEVICE AND ELEMENT THEREFOR

TECHNICAL FIELD

The invention relates to a wet surface treating device and a rotatable element useful in the conversion of a conventional dry surface treating device into a wet device.

BACKGROUND ART

Various surface treating devices of the type which includes a drive means having a rotatable output shaft with a free end upon which is mounted a rotatable element including a surface treating means are known. Well known examples of such a surface treating device are circular orbital sanders for sanding various surfaces such as metal or plastic surfaces which may be primed or painted and the like.

Such surface treating devices have been used dry, i.e., without the application of any liquid to the interface between the surface treating means and the surface being treated. Such dry operation is particularly undesirable because it creates large quantities of the airborne particulate material, causing quantities of particulate material to settle on adjacent areas and creating a potential hazard to people in the immediate area unless appropriate dust filtering devices are employed.

Wet surface treatment is also used to prevent loading or clogging of the surface treating element, e.g., coated abrasive sheet, nonwoven abrasive product, polishing pad, or the like, to reduce heat build-up, to improve the surface treatment, e.g., to impart an effect from the liquid used such as coating or polishing and for other purposes.

The benefit of wet surface treatment for rotary pad or disc applications was recognized many years ago but equipment to perform such a task was limited and inefficient. Early efforts to avoid some of the problems associated with dry surface treating and to provide wet surface treating with such devices involved first wetting the surface being treated or the surface treating means by separate external means. This provided a very brief solution of the problem since no continuous liquid supply was available. Various modifications have been made to such surface treating tools to provide a continuous source of liquid, but such modifications have increased significantly the cost of the device. Moreover, there is no known convenient means of converting unmodified devices to permit continuous wet surface treatment by supplying liquid when needed to the central portion of the surface treating pad without drastic modification of the device. One such modification, which provides a supply of liquid to the central portion of the pad or disc is the replacement of the output shaft with a hollow one to which is connected a liquid supply which is passed through the pad through a central opening. Such a modification is quite effective but it does not permit the device owner to make the modification since it requires substantial rebuilding of the device.

Examples of modified surface treating tools are shown in the following U.S. Pat. Nos.:

Bloomquist (4,102,084) disclosing a motor vehicle sanding device including a water line through the device;

Smart et al (4,129,966) disclosing a hand held grinder with water supplied from a source through a port to a sealed annular chamber surrounding the outer output shaft;

Teaque, Jr. (4,175,359) disclosing an orbital wet sander including a driving water stream which is discharged to the working surface to effect wet sanding.

Thielen (3,793,665) disclosing a floor-treating machine head assembly having openings therethrough which permit dispensing of shampoo and detergent solutions through the head assembly.

While the latter patent describes a commercially acceptable means of supplying liquid through the head assembly of the machine through openings, the liquid is not supplied to the center of the working face of the rotating pad of the machine or to the axis of rotation where it would desirably be supplied.

DISCLOSURE OF THE INVENTION

The present method provides a convenient, relatively inexpensive way of converting conventional dry surface treating devices into wet surface treating devices to provide a device having a generally centered liquid supply on the working face of the rotatable element, e.g., a pad or disc.

The present method provides a surface treating device of the type which includes a drive means having a rotatable output shaft having a free end upon which is mounted a rotatable element comprising a surface treating means and liquid supply means to provide a sufficient quantity of liquid for wet surface treating. No modification of the surface treating device is required other than the substitution of the rotatable element and the addition of an external liquid supply. The rotatable element has a first surface including a shaft mounting means for rotation of the element about an axis generally transverse to the first surface and an opposite second surface comprising or being capable of including a surface treating means. The first surface includes a basin-like recess having a generally transverse bottom surface which is substantially free of radial undulations, and sidewalls defining a channel opening toward and extending around the axis. The opposite second surface includes an opening within or adjacent to an area thereof generally centered with respect to the axis. The rotatable element includes at least one passage therethrough communicating between the channel and the opening so that liquid collected in the recess will flow into the channel, through the passage and out of the opening when the element is stationary or rotated about the axis.

The phrase "substantially free of radial undulations" means that the transverse bottom surface of the recess is free of gross radial undulations which would cause liquid to be expelled upwards therefrom rather than to flow thereover to the channel as the element is rotated about the axis of rotation. Some minor undulations will not interfere with the flow of liquid. The tolerance for more pronounced undulations increases, of course, as the rotation rate in use decreases.

The preferred modified device is an orbital or circular rotational sander.

It should be noted that the term "rotatable element" is used herein in a somewhat broader sense in that it is not intended to refer only to a pad or disc which is circular in shape but may have a shape other than circular as typically found in devices of this type as known in the art most related to this subject. The rotatable element may be any conventional element for this purpose including, for example, a resilient pad (e.g., formed of a foam), a combination of a resilient pad with a back plate or a rigid disc assembly. The preferred rotatable element is in the form of a disc, most preferably having the opening in the opposite surface centered with respect to the axis of rotation. The centered opening preferably leads to a cavity in the pad, which cavity has a cylindrical sidewall having, with respect to a point on the edge of the disc, a leading portion and a following portion in the direction of rotation. The passage of the preferred disc is centered on a line (most preferably straight) extending from the point on the edge of the disc to a point on the following portion of the sidewall of the cavity. The entrance opening of the passage is most preferably in close proximity to the axis of rotation. Most preferably the disc includes two or more passages in equally spaced radial relationship.

BRIEF DESCRIPTION OF THE DRAWING

The invention is further detailed in the following description which should be read in connection with the accompanying drawing wherein like reference characters refer to similar parts throughout the various views and in which.

DESCRIPTION OF THE PREFERRED EMBODIMENT

Figure 1:
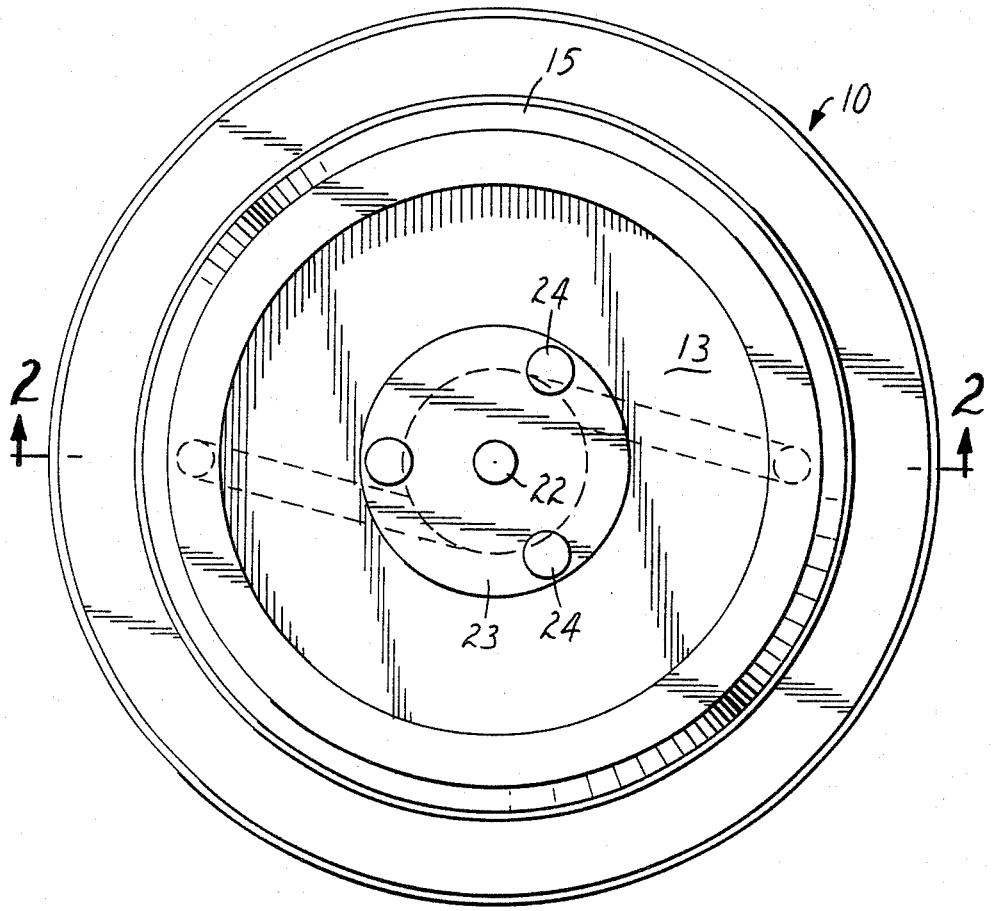
FIG. 1 is a plan view of the top of a rotatable element according to the invention.
Figure 2:
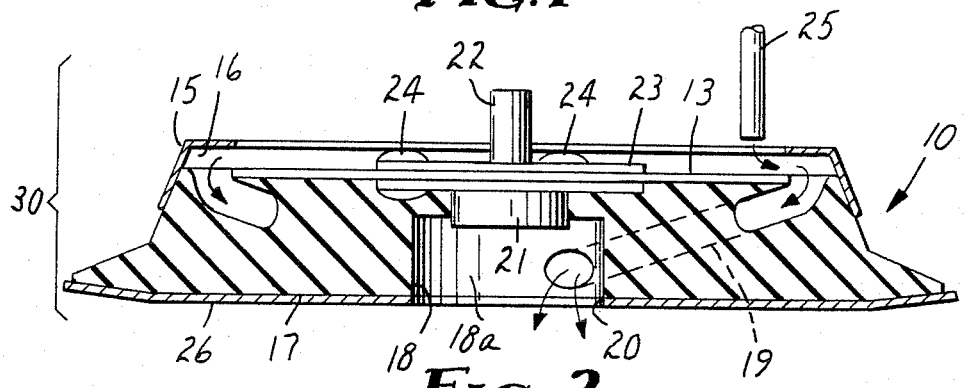
FIG. 2 is a sectioned side elevational view illustrating a surface treating device according to the invention which includes the rotatable element depicted in FIG. 1 taken at line 2—2, as indicated.

Referring to FIGS. 1 and 2 of the drawing, a rotatable element herein described, in the form of a disc indicated by reference numeral 10, includes a first surface 13 having mounted thereon conventional attachment means such as shaft 22 for rotation of disc 10 about an axis of rotation and for mounting on the end of an output shaft of a conventional drive means of a surface treating device (not shown) and a basin-like recess having a generally transverse bottom surface 13 and walls 15 defining a channel 16 opening toward and extending around the axis of rotation. Disc 10 also includes opposite surface 17 which includes a surface treating means such as a sheet 26 of attached abrasive material. Surface 17 includes an opening 18 into liquid-receiving cavity 18*a* within or adjacent an area generally centered with respect to the axis of rotation. At least one passage 19, preferably two passages as shown, is included in pad 10 communicating between channel 16 and opening 18 so that liquid collected in channel 16 will flow out of opening 18 when disc 10 is stationary or rotated about the axis of rotation. Preferably the sheet of abrasive material has an opening 20 therethrough corresponding to opening 18 in opposite surface 17 to provide a way for liquid to pass from opening 18 to the abrasive face of abrasive sheet 26 in use.

First surface 13 of disc 10 includes suitable mechanical means to hold shaft 22 in place, such as a flange 21 at the end of a rotatable shaft 22 which is held in place on base plate assembly 23 by rivets or screws 24. Other suitable fastening means are also useful, of course.

The surface treating device herein described, generally indicated by reference numeral 30, includes a conventional drive means (not shown) such as an air motor or an electric motor which includes a rotatable output shaft which is mechanically fastened to shaft 22 of disc 10 and liquid supply means (not shown) which provides liquid through tube 25 onto surface 13 within the area defined by sidewalls 15.

Disc 10 may be formed of a material which may be quite deformable (e.g., foamed polyester) to quite firm (e.g., molded rigid plastic or metal), depending upon the requirements of the user, as is known in the art. Sidewalls 15 are preferably an integral part of the body of disc 10 but need not be of the same material. Pad 10 may be molded with sidewalls 15 or sidewalls 15 may be formed separately and subsequently added by suitable means. Disc 10 may be in any convenient shape or size, but preferably is in the form of a disc having a beveled edge, as shown. For the embodiment depicted in FIGS. 1 and 2, sidewalls 15 are preferably placed somewhat within the perimeter of pad 10, providing sufficient surface area within sidewalls 15 to receive liquid. Sidewalls 15 are preferably fully erect and of a sufficient height to prevent liquid applied to surface 13 from being discharged therefrom as pad 10 is rotated. Sidewalls 15 may include inwardly extending flange or may be biased inwardly to provide ring-like channel 16 which easily retains liquid during rotation.

Opposite surface 17 may include any of a variety of surface treating means such as a sheet of pressure-sensitive adhesive backed coated abrasive material, nonwoven abrasive pads, polishing pads, buffing pads and the like.

An example of a surface treating device contemplated for modification by the present invention is a conventional orbital sander although other surface treating devices may be similarly modified. The disc modified as described herein is similar to the disc which is commercially available under the trade designation "Stickit Disc Pad" from Minnesota Mining and Manufacturing Company, St. Paul, Minn.

In use, the surface treating device is activated to cause shaft 22 to rotate and the liquid supply means is activated to cause liquid to flow through supply tube 25 onto surface 13 and liquid, typically water, passes through passage 19 out of opening 18 onto the working face of the surface treating means to provide wet surface treating. The liquid supply means preferably includes a shut-off valve which may be employed to reduce, increase or completely cut off liquid supply.

Figure 3:
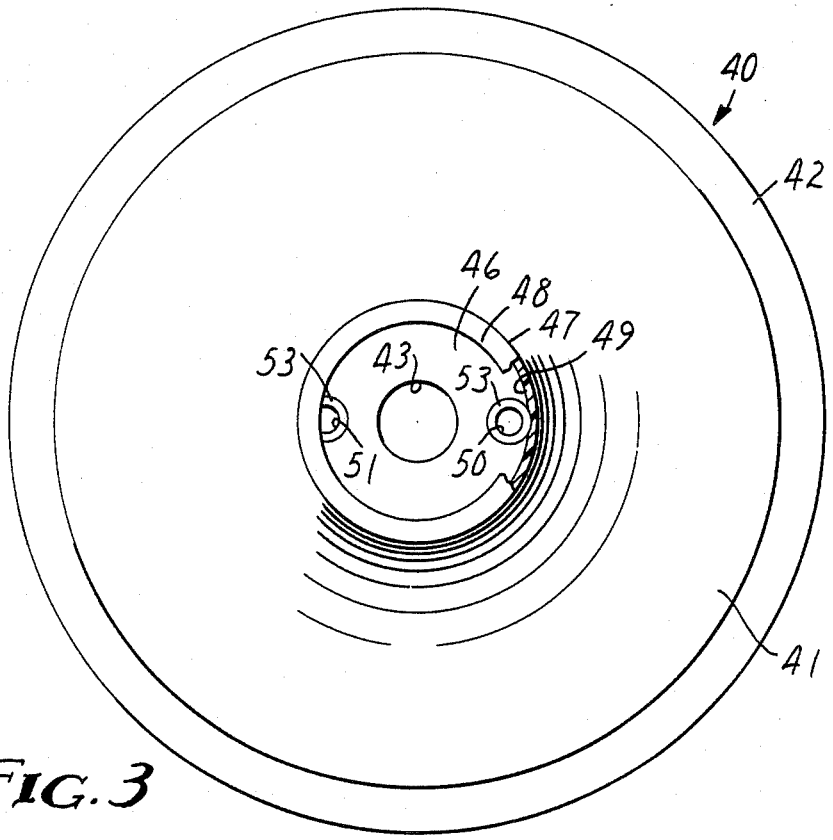
FIG. 3 is a plan view of the top of another rotatable element according to the invention.
Figure 4:
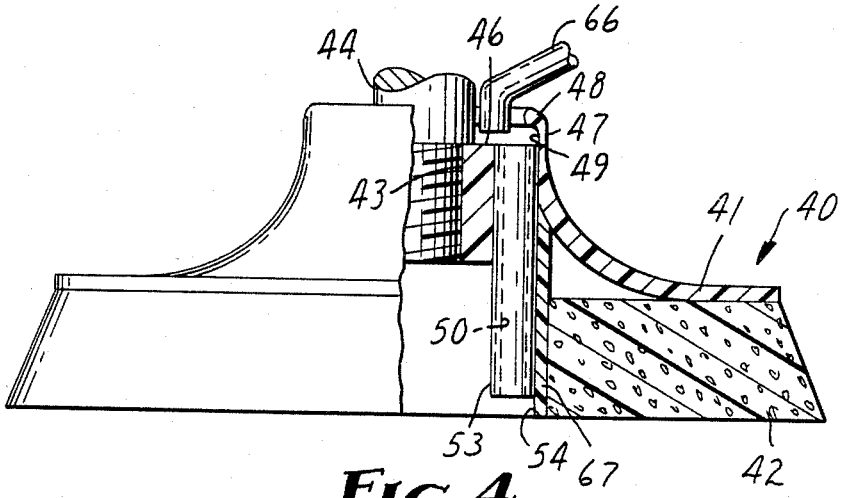
FIG. 4 is a side elevational view of the rotatable element depicted in FIG. 3 with parts broken away to show detail in sections.
Figure 5:
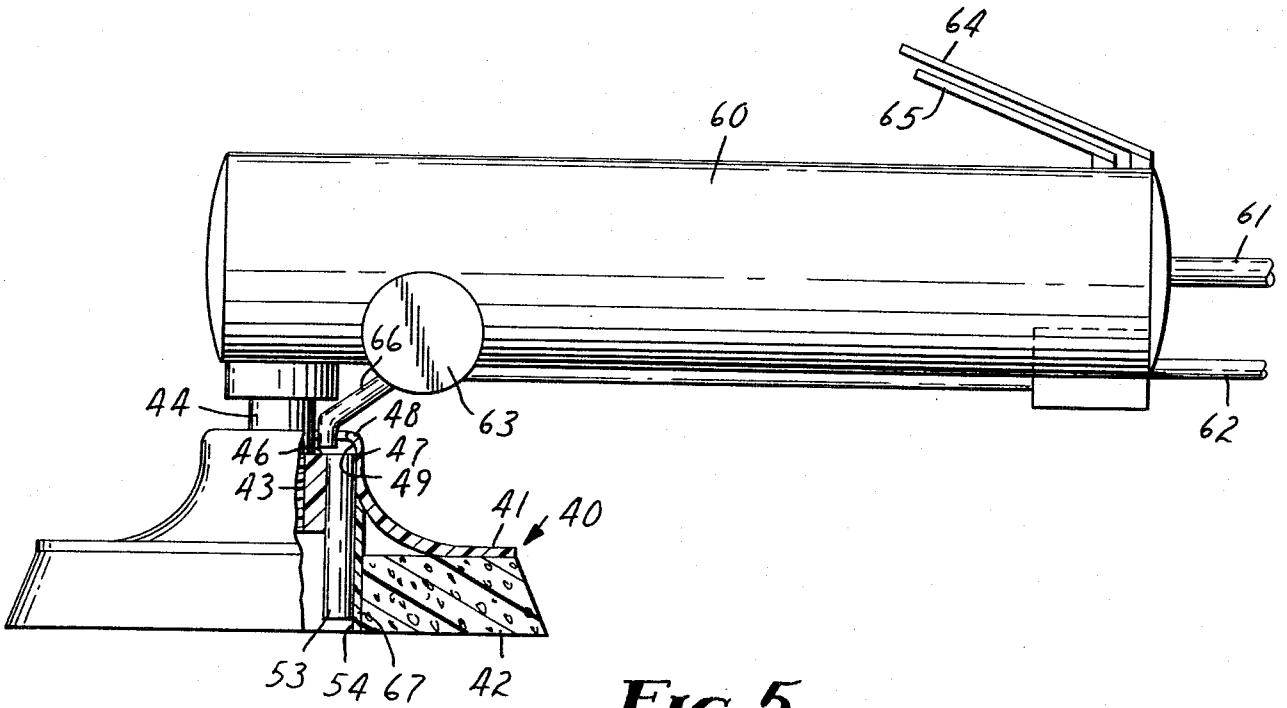
FIG. 5 is a side elevational view illustrating a surface treating device according to the invention which includes the rotatable element depicted in FIG. 4.

Referring now to FIGS. 3–5, there is shown another embodiment of the improved rotatable disc prepared according to the present invention. FIG. 5 shows the rotatable disc fastened to a conventional surface treating device.

The rotatable element 40 shown in FIGS. 3–5 includes a stiff bell-shaped flange 41 which has a resilient pad 42 fastened to its working face and a centrally disposed means, e.g., threaded center bore 43, for engagement with the end of output shaft 44 of a conventional surface treating device. Output shaft 44, or a suitable adaptor attached thereto, when secured within threaded center bore 43, preferably forms a liquid barrier in surface 46. The upper surface portion of rotatable element 40 includes a basin-like recess having a bottom surface 46 and sidewalls 47 which include inwardly directed ridge 48 to provide channel 49. Opposed passages 50 and 51 provided by tube-shaped elements 53 extend from surface 46 to generally centrally disposed opening 54 of pad 42. As shown in FIG. 5, a modified surface treating device includes a drive means such as air motor 60 which is fitted with air supply 61, water supply 62, water metering valve 63 and air and water shut-off valves 64 and 65, respectively. Water entering through valve 63 is directed onto surface 46 through tube 66. In use, the air and water supplies are preferably simultaneously turned on and off.

In a preferred embodiment, resilient pad 42 is formed of an open-called foam, since such foams have the desired compressibility, but undesirable water-retention properties. To overcome the latter water-retention property, a sleeve 67 of resilient, liquid impervious material such as may be provided by a closed-cell foam is used to line the opening in pad 42.

It will of course be understood that various changes may be made in the form, details, arrangement and proportions of the parts without departing from the scope of the invention herein.

I claim:

1. A rotatable element capable of being mounted on the end of an output shaft of a motor-driven surface treating device, said element having a first surface including a shaft mounting means for rotation of said element about an axis generally transverse to said first surface and an opposite second surface including a flexible pad for adhesively attaching a coated abrasive sheet, said first surface including a basin-like recess having a bottom surface which is generally transverse to said axis and substantially free of radial undulations and including sidewalls defining a channel opening toward and extending around said axis, said opposite second surface including a flexible pad having an opening within or adjacent to an area thereof generally centered with respect to said axis, and at least one passage through said element communicating between said channel and said opening so that liquid collected in said recess, will flow into said channel, through said passage and out of said opening when the element is stationary or rotated about said axis, said pad comprising open-celled foam and the portion of said pad surrounding said opening being lined with a sleeve of a resilient liquid-impermeable material.

* * * * *